United States Patent [19]

Daane

[11] 4,369,584

[45] Jan. 25, 1983

[54] PREVENTING AIR FILM BETWEEN WEB AND ROLLER

[75] Inventor: Robert A. Daane, Green Bay, Wis.

[73] Assignee: W. R. Grace & Co., New York, N.Y.

[21] Appl. No.: 254,989

[22] Filed: Apr. 16, 1981

[51] Int. Cl.[3] ..... F26B 5/00

[52] U.S. Cl. ..... 34/12; 34/23; 34/120; 34/122; 34/160

[58] Field of Search ..... 34/114, 117, 120, 122, 34/159, 160, 12, 16, 20, 23, 34

[56] References Cited

U.S. PATENT DOCUMENTS

| | | | |
|---|---|---|---|
| 3,452,447 | 7/1969 | Gardner . | |
| 3,633,284 | 1/1972 | Rodwin | 34/114 |
| 3,733,711 | 5/1973 | Haythornthwaite | 34/114 |

*Primary Examiner*—Larry I. Schwartz
*Attorney, Agent, or Firm*—James E. Nilles

[57] ABSTRACT

A web moving in one direction and having partial wrapping engagement with a cylindrical surface of a rotating roller is impacted by an air jet which forces it into intimate contact with the roller, preventing intrusion of an air film between the roller and the portion of the web curved around it. The jet issues from a nozzle to which pressure air is fed (at, e.g., 3 psi) and the outlet of which is a slot long enough to extend across the full width of the web but as narrow as feasible, e.g., 0.030 in. The nozzle is so arranged that the jet impacts the web within a short distance (e.g., ½ in.) in the direction of web travel from the line of tangency of the web to the roller, and is close enough to the web (e.g., about ⅛ in.) to avoid substantial dispersion or divergence of the jet before it impacts the web. Effectiveness of the jet is due to the high pressure gradient in the direction of web travel that it imposes upon the web, not to absolute pressure.

7 Claims, 2 Drawing Figures

PREVENTING AIR FILM BETWEEN WEB AND ROLLER

FIELD OF THE INVENTION

This invention relates to a method and means for ensuring intimate contact between a web that moves lengthwise in one direction and a cylindrical surface of a roller around which the web has partial wrapping engagement and which rotates to have the peripheral speed of its said surface match the lengthwise speed of the web; and the invention is more particularly concerned with a method and means that employs an air jet for preventing the intrusion of an air film between a web and a roller around which the web has partial wrapping engagement.

BACKGROUND OF THE INVENTION

In various processes such as paper making, printing and coating, a lengthwise moving web is, at some point in its path, brought into partial wrapping engagement around a rotating roller so that the web can have intimate contact with the cylindrical surface of the roller for heat transfer or for some other purpose. A problem that has heretofore persisted in connection with such processes is that there is a tendency for a film of air to intrude between the web and the cylindrical surface of the roller, preventing the desired contact between them.

It is known that air is picked up by the moving surfaces of the web and the roller and that some of this air becomes trapped in the wedge-shaped space where the web approaches the roller surface. Unless the web is under a relatively high lengthwise tension, or is moving lengthwise at a relative low speed, the trapped air enters between the roller and the portion of the web that curves around it, forming a film a few thousandths of an inch thick between the roller and roller and all of that portion of the web that is wrapped around it.

If web speed is low enough and the web is under sufficient lengthwise tension, the trapped air in the above-mentioned wedge-shaped space is repelled by the pressure of the web pushing onto the cylindrical surface of the roller. The pressure p exerted by the web in pushing onto the roller surface, in pounds per square inch (psi), is given by:

$$p=t/r,$$

where t is web tension in pounds per lineal inch (pli), and r is cylinder radius in inches.

Thus, if a paper or plastic web is under a typical tension of 2 pli and is running around a 12-inch diameter roller, the pressure that pushes the web towards the roller surface is $\frac{1}{3}$ psi. If the speed of the web and cylinder is very low (e.g., less than 100 fpm) a $\frac{1}{3}$ psi web pressure is high enough to almost completely repel the air in the wedge-shaped space from entry between the roller and the portion of the web that curves around it, and the web will make reasonably good contact with the roller surface. Of course, perfect smoothness of the web and roller surfaces is unattainable in practice, and some air will be present between those surfaces in the void spaces defined by surface irregularities, but there will be substantial surface-to-surface contact in contrast to the substantially total separation between the surfaces that exists when a film of air is present.

With a high web speed—e.g. 1,500 to 2,000 fpm— a $\frac{1}{3}$ psi web pressure is not enough to prevent formation of a film of air between the roller and the curved stretch of web that is intended to contact it.

It will be evident that where a web is to be heated or cooled by a roller around which it is partially wrapped, an insulating film of air between the web and the roller will materially reduce the efficiency of heat transfer. If a freshly imprinted or coated web is passed through an oven and is then brought to a chill roll to be cooled, an air film that intervenes between the web and the chill roll prevents cooling of the web to the temperature it is intended to have upon moving away from the chill roll, and troubles may be encountered in subsequent stages of processing of the web. Furthermore, the air film may allow solvent to condense on the chill roll surface, forming rather thick layers or ribbons of condensate that the web intermittently reabsorbs in sufficient amounts to resoften the ink.

In web winding and rewinding operations, wherein a substantial length of web is wound onto itself to form a continuous roll, air trapped between the oncoming web and the already-wound part of the roll can form a film between successively wound layers, resulting in a roll that has an excessive diameter, is too loosely wound, and may create problems during subsequent handling or use, as by telescoping when tilted.

Again, where an idler roll is to be driven by means of a moving web, a thin film of air between the web and the roll reduces the friction force needed for driving the roll, and serious slippage between them may result.

The development of an air film between a web and a roller around which it has partial wrapping engagement can sometimes be avoided by mounting a pressure roller in juxtaposition to the roller to be contacted by the web, whereby the web is literally squeezed into contact with that roller. However, there are many situations in which this expedient cannot be used because the web surface that faces away from the roller to be contacted cannot tolerate engagement by a solid object.

U.S. Pat. No. 3,452,447, issued to T. A. Gardner in 1969, points out that holding a web tightly to a drum such as the steam cylinder of a dryer "has long presented problems" due to entrained air trapped between the web and the drum, "thereby greatly reducing the transfer of heat." The patent proposes to mount an air bar to blow air against the web from the side of it that is opposite the drum, the air bar being positioned along the line at which the web is tangent to the drum. The patent recognizes that blowing air directly towards the web in an effort to force it into contact with the drum would normally be ineffectual because the air jet or jets, after impacting the web, would be deflected or redirected by it into flow along its surface that would produce a lift effect; and "the lift effect of the redirected jets is sufficiently great so that it tends to nullify the pressure exerted by the jets." Instead, Gardner's air bar has a pair of outlets which are spaced apart by a small distance in the direction of movement of the web and from which air jets issue towards the web at opposite substantially oblique angles to its surface such that they converge towards one another. The convergent air jets are said to produce a pressure zone between the air bar and the web, in the region between the outlets from which they are emitted, and the patent states that "the pressure exerted over the relatively large area of the pressure zone [is] so much greater than the lift effect of the redirected jets that the latter ceases to be of any consequence."

The expedient disclosed by Gardner may be of value where web tension is rather high—as expressly contemplated by the patent—and with moderate web speeds, but it is doubtful that it would be effective with relatively high web speeds and small or moderate tensions. In all cases it would require a substantially high rate of air flow to be effective and would therefore consume a substantial amount of energy in its normal operation.

SUMMARY OF THE INVENTION

The general object of the present invention is to provide a simple, inexpensive and energy-efficient method and means for preventing the intrusion of an air film between a lengthwise moving web and a cylindrical surface on a rotating roller around which the web has partial wrapping engagement, thereby maintaining intimate contact between the web and the roller; and to effect this result without engaging any solid object against the surface of the web that faces away from said roller.

Another and more specific object of the invention is to provide a method and means for forcing a lengthwise moving web into intimate contact with a cylindrical surface on a rotating roller by means of a jet of air which is emitted directly towards the web but which, contrary to what the prior art might suggest, produces no significantly adverse lifting effect upon the web and, moreover, requires only a moderate pressure and a relatively small rate of air flow to be effective.

In general, the present invention resides in the provision of a method and means that takes advantage of certain pressure relationships which have apparently not been taken into account in previous attempts to solve the problem with which the invention is concerned.

Considered as a method, the invention ensures intimate contact between a web that moves lengthwise in one direction along a defined path and a roller with a cylindrical surface around which the web has partial wrapping engagement and which rotates to maintain its said surface at a peripheral speed matching the lengthwise speed of the web. The path in which the web is constrained to move has one portion in which the web is straight and extends in said one direction towards the roller and has another portion which begins at the termination of said one portion and in which the web is curved around the roller. In this method, a jet of air is directed towards the web from the side thereof opposite the roller. The characterizing features of the method are: that the jet extends substantially entirely across the web along a line transverse to the length of the web and impacts the web within a short distance in the direction of web travel from the termination of said one path portion; and that the jet impacts the web in a zone which has an extension in said direction that is on the order of a few hundredths of an inch, so as to impose upon the web a pressure gradient in said direction that is high, notwithstanding that the impact pressure of said jet against the web may be relatively low.

Considered from the standpoint of apparatus, the invention provides improvements in air jet control means for substantially preventing the intrusion of an air film between the roller and the web, to ensure intimate contact between them. Said air jet control means comprises a nozzle to which pressurized air is fed and which is at the side of the web opposite the roller, said nozzle having an outlet for pressurized air that opens towards the web. The air outlet is elongated transversely to the length of the web and extends substantially across the full width of the web. The nozzle is located to have its outlet within a small distance in the direction of web travel from the line of tangency of the web to the cylindrical surface of the roller. The width of the air outlet, as measured in the direction of web movement is not substantially greater than is adequate to ensure issuance of air therefrom at a substantially uniform rate all along its length. The distance between the nozzle and said surface of the roller is large enough to accommodate the thickness of the web and permit air to issue from the nozzle outlet as a jet that impacts the web, but it is small enough to prevent substantial divergence of said jet in said direction.

BRIEF DESCRIPTION OF DRAWINGS

In the accompanying drawings, which illustrate what is now regarded as a preferred mode of practicing the invention.

DETAILED DESCRIPTION OF PREFERRED EMBODIMENT OF THE INVENTION

Figure 2:
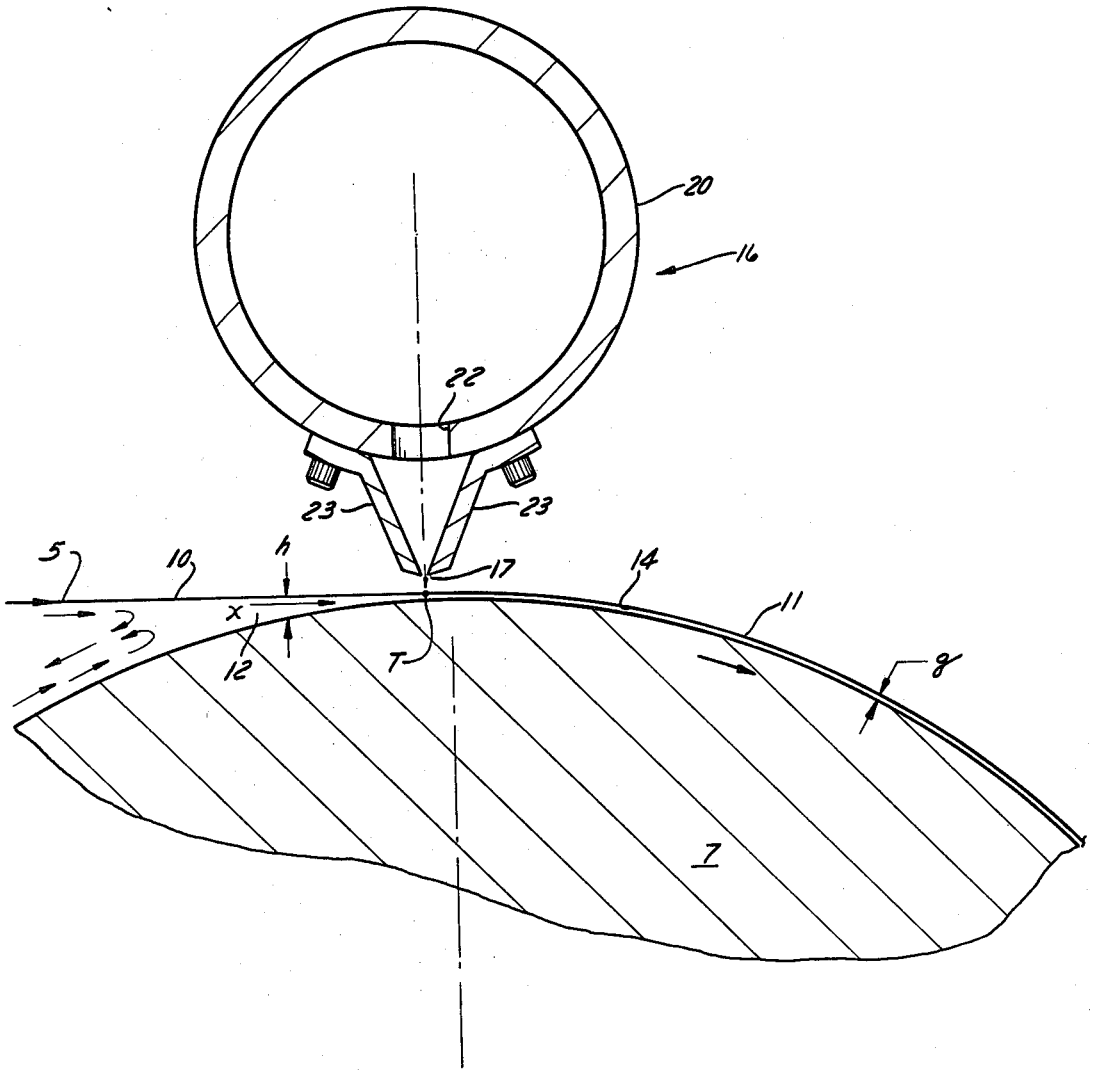
FIG. 2 is an enlarged view of a portion of the apparatus shown in FIG. 1.

In a typical application of the principles of this invention, a web 5 of indefinite length, freshly imprinted or coated on at least one of its surfaces, emerges from a drying oven 6 and passes to a chill roll 7 that has a cylindrical surface around which the web 5 has partial wrapping engagement. The web is thus constrained, as by air bars 8 and a guide roller 9, to move lengthwise along a defined path, in a direction from the oven 6 to the chill roll 7. In one portion 10 of its path the web 5 is straight, extending in its direction of movement towards the chill roll 7. That straight path portion 10 terminates at a line of tangency of the web to the cylindrical surface of the chill roll, which line is of course parallel to the chill roll axis and is seen as a point T in the side view, FIG. 2. Through another portion 11 of its path, which begins at the line of tangency, the web is curved around the chill roll 7.

As it moves lengthwise in the direction just mentioned, the speed of the web may normally be rather high (e.g., on the order of 2,000 fpm). The chill roll 7 is constrained to rotate in the direction and at the rate such that the peripheral speed of its cylindrical surface is matched to the lengthwise speed of the web.

Even though the web and the roller 7 may have relatively smooth surfaces, air is induced to flow along with them and into the wedge-shaped space 12 in the zone where the web approaches contact with the roller 7. Because of the induced flow, air in the wedge-shaped space 12 has an above-atmospheric pressure and tends to force itself between the roller 7 and the portion of the web 5 that curves around it. As pointed out above, if web tension is high, the web may exert sufficient pressure towards the roller surface to prevent air from intruding between the opposing curved surfaces of the web and the roller; but the above-atmospheric pressure in the wedge-shaped space 12 increases with increasing web speed, and at normally high web speeds the lengthwise tension on the web would have to be substantially higher than would normally be acceptable in order to exclude air from between the web and the roller 7. Therefore, without some preventive measure, the portion of the web that curves around the roller 7 will be separated from the cylindrical surface of the roller by a distance of a few thousandths of an inch, defining a channel 14.

The parameter that is of significance with respect to intrusion of air between the web 5 and the roller 7 is the web pressure gradient through the zone in which the web approaches the roller, that is, the change in pressure per unit distance along the web in the direction of web travel. For web speeds, roll diameters and web tensions that are of most interest in normal web processing, it is possible, with reasonable accuracy, to neglect inertial forces associated with air and web movement, including centrifugal force of the web, and to consider that the air behaves as a viscous Newtonian fluid. Further, since the air flow channel 14 between the web and the roller surface is very thin compared with the length of that channel, the air flow in that channel can be regarded as one-dimensional. On those premises, the air flow and pressure variation can be analyzed on the basis of lubrication theory.

For the configuration here under consideration, the pressure gradient is given by:

$$\frac{dp}{dx} = 12\mu\, s\,(h - g)/h^3,$$

where (see FIG. 2):

x is the distance along the web in the direction of its travel, $\mu$ is the absolute viscosity of the air, h is the gap or distance between the web and the roller surface as measured perpendicular to the surfaces of the web, s is web and cylindrical surface speed, and g is the minimum distance between the web and the roller surface.

It will be seen that the maximum value of this pressure gradient is reached at the point along the web path where $$h = 3/2\ g.$$

At that location the value of dp/dx is:

$$\frac{dp}{dx} = \frac{16\mu\, s}{9g^2}.$$

This relationship shows that in order to achieve a certain minimum gap thickness g between the web and the roller, the pressure that pushes the web towards the roller must vary in such a way along the length of the web that the pressure gradient or steepness of the curve of pressure versus distance x is no less than some definite value. A typical desired value for g could be 0.0001 in., which represents the order of roughness dimension for some webs and would signify that the web is in contact with the cylinder surface to the extent that surface roughnesses permit. For this value of g, and with a web and roller speed of 1800 fpm, the pressure gradient must be 166 psi per inch along the web. Such a pressure gradient cannot be achieved by web tension and web curvature with practical values of web tension and roller diameter.

To achieve such a pressure gradient by applying pressure air to the web, to be translated into pressure of the web in the direction towards the roller, it is not practical to use a supply air pressure of more than a few pounds per square inch. However, as appears from the foregoing analysis, the significant factor is not the absolute pressure against the web (and of the web towards the roller) but the pressure gradient along the web. Thus, there is little value in blowing air against the web in such a manner that the impacting air applies pressure to the web substantially uniformly along a relatively long stretch of it in the direction of web travel, for in that case even highly pressurized air would not produce the high gradient— increase in pressure per unit web length—that is necessary to accomplish the desired result.

Instead, according to the present invention, the necessary high pressure gradient is obtained by causing pressurized air to issue from a nozzle 16 as a long but very narrow jet that extends entirely across the width of the web but impacts the web in a zone that extends along its length for a distance of not more than a few hundredths of an inch. Thus the outlet 17 in the nozzle 16, from which the air jet is emitted, takes the form of a long but very narrow slot that has its length oriented transversely to the length of the web and has its opposite ends at or beyond the side edges of the web.

Since the air jet should be as narrow as possible in the direction lengthwise of the web, the width of the nozzle outlet slot 17 should be as small as is consistent with manufacturing practices and maintenance of tolerances and merely wide enought to avoid clogging and assure a substantially uniform outflow of air at all points along its length. A slot width of 0.030 inch has been found satisfactory from the standpoint of manufacturing facility and satisfactory operation.

The nozzle 16 should be so located that its outlet 17 is within a short distance in the direction of web movement from the line of tangency T between the web 5 and the roller 7. By a short distance is meant a distance not substantially greater than about ½ inch (12 or 13 mm). If located too far beyond the line of tangency, the jet loses some of its utility because web ahead of it is permitted to remain out of contact with the roller. The nozzle can be so located that its outlet 17 is substantially on the line of tangency, but it should not be substantially ahead of that line relative to the direction of web travel.

Since the jet that issues from the outlet slot 17 should be as narrow as possible in the direction along the length of the web, the nozzle should be as close as practicable to the web, so that the jet does not broaden, disperse or lose much velocity before it impacts the web. Preferably the nozzle should not be spaced from the web by a distance substantially greater than four times the width of its slot outlet.

It must be borne in mind that for maintenance of a given gap g between the web and the roller under a given set of conditions, increased width of the outlet slot 17 requires an increase in the pressure of the air fed to the nozzle and also requires an increase in the rate of air flow through the nozzle; hence the power required for generation of the necessary pressure air increases more than proportionally to the square of the slot width. Thus, operating efficiency depends upon having the width of the outlet slot 17 at the smallest feasible value, since any excessive width of that slot results in an increase in the power required for maintaining an effective jet without any accompanying improvement in the operation of the device. With a slot width in excess of about 0.080 in., the gains resulting from intimate contact between the roller and the web would probably not offset the energy expended in maintaining such contact.

Figure 1:
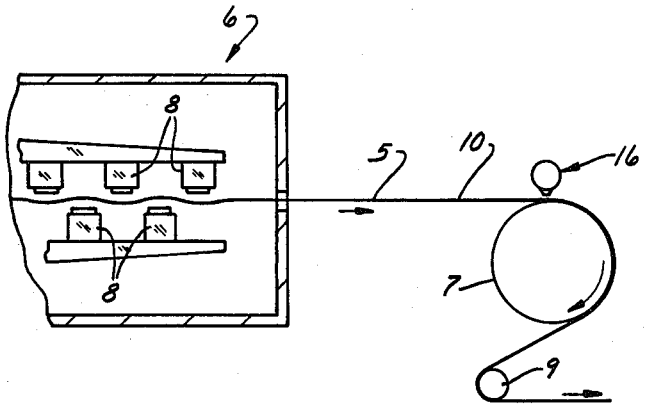
FIG. 1 is a more or less diagrammatic view in side elevation of a portion of apparatus which embodies the principles of this invention and wherein a web moves lengthwise in one direction to and partially around a cylindrical surface of a rotating roller.
Figure 3:
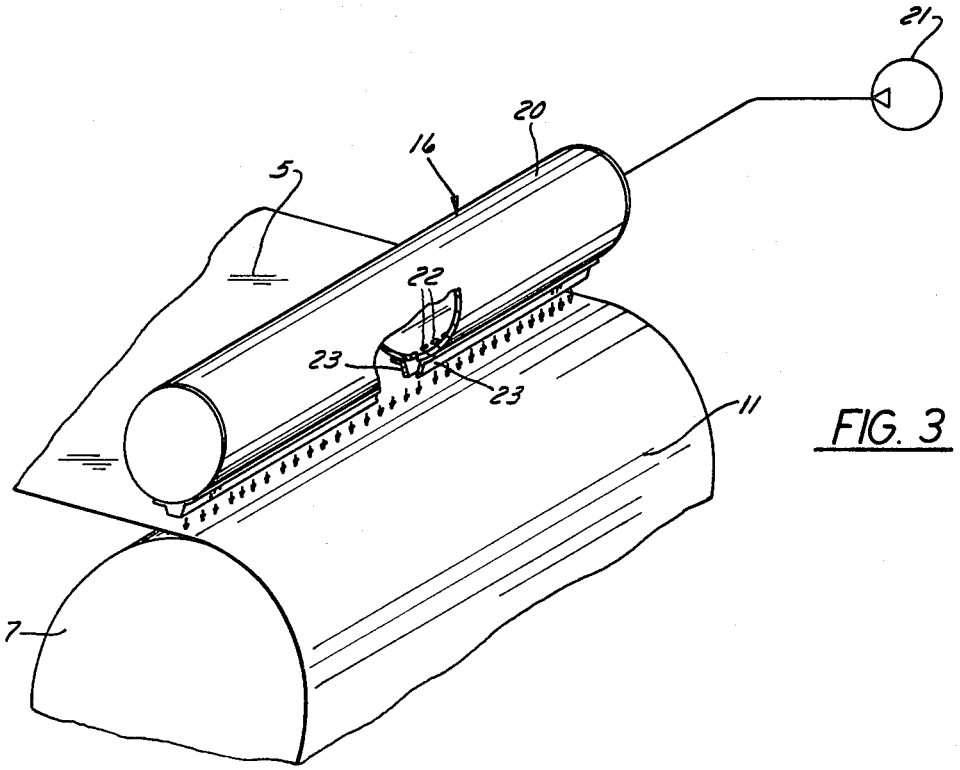
FIG. 3 is a diagrammatic perspective view of an air nozzle suitable for practicing the invention.

FIG. 3 depicts a nozzle 16 of a type that has been successfully tested in the practice of this invention. It comprises a pipe 20 having a length at least equal to the full width of the web. One end of the pipe 20 is plugged in any suitable manner and pressure air is brought into its other end in any suitable manner, as from a pump 21. A row of holes 22 in the bottom of the pipe 20 open into its outlet portion, which is defined by a pair of downwardly convergent plates 23 that are welded or otherwise sealingly connected to the pipe along their respective upper edges. The lower edges of the respective plates 23 are spaced apart (as by a distance of 0.030 inch) to define the outlet slot 17.

A nozzle of the type shown in FIG. 3 was built and installed in proper juxtaposition to a 12-in diameter chill roll, to determine its effectiveness in increasing contact between a web and the chill roll. Air was fed to the nozzle at 3 psig, and the nozzle had an outlet slot width of 0.030 in.±0.002 in. At a web speed of 1800 fpm, and with a web tension of 2 pli, the heat transfer coefficient between the web and the chill roll, with the nozzle not in operation, was 200 BTU/hr.-ft.$^2$-°F.; whereas with the nozzle operating it was 490 BTU/hr.-ft.$^2$-°F. Thus heat transfer was increased by about $2\frac{1}{2}$ times by reason of the operation of the nozzle, not only indicating the achievement of intimate contact between the web and the roller but also demonstrating the value of obtaining such contact.

From the foregoing description it will be apparent that this invention provides a simple and energy efficient method and means for ensuring contact between a lengthwise moving web and a rotating roller around which the web has partial wrapping engagement.

What I claim is:

1. In apparatus wherein a web is confined to lengthwise motion in one direction along a defined path and wherein said path has one portion in which the web extends substantially straight and has another portion which begins at the termination of said one portion and in which the web is curved in partial wrapping engagement with a cylindrical surface of a roller that rotates to have the peripheral speed of its said surface match the speed of lengthwise motion of the web, means for substantially preventing the intrusion of an air film between the roller and the web to ensure intimate contact between them, said means comprising:

A. an air nozzle at the side of the web opposite said roller, having an elongated and narrow outlet that opens towards the web, the outlet of said nozzle
  (1) having its length extending transversely to the the length of the web, substantially across the full width of the web,
  (2) having a width substantially less than 0.1 inch (2.5 mm),
  (3) being located within a small distance in said direction of web motion from the termination of said one portion of said path, and
  (4) being spaced from said surface of the roller by a distance not substantially greater than is sufficient to accommodate the thickness of the web between the nozzle and said surface of the roller and to permit air to issue from said outlet as a stream that impacts the web in a zone having very small extension in said direction; and B. means for conducting pressurized air to said nozzle to issue from said outlet.

2. The apparatus of claim 1 wherein
(1) the width of said outlet is on the order of 0.030 inches and
(2) said nozzle is spaced from the web by a distance which is not substantially greater than four times the width of said outlet.

3. In apparatus wherein a web is confined to lengthwise motion in one direction along a defined path and wherein said path has one portion in which the web extends substantially straight and has another portion which begins at the termination of said one portion and in which the web is curved in partial wrapping engagement with a cylindrical surface of a roller that rotates to have the peripheral speed of its said surface match the speed of lengthwise motion of the web, air jet web control means for substantially preventing the intrusion of air between said roller and the web, said web control means comprising a nozzle at the side of the web opposite said roller, to which pressure air is fed and which has an outlet for pressure air that opens towards the web, said web control means being characterized by:

A. said outlet in the nozzle being elongated transversely to the length of the web and extending substantially across the full width of the web;
B. said outlet being within a small distance in said web motion direction from the termination of said one portion of said path;
C. said outlet having a width not substantially greater than is adequate for issuance of air therefrom at a substantially uniform rate all along its length; and
D. said nozzle being spaced from said surface of the roller by a distance large enough to accommodate the thickness of the web and permit air to issue from the outlet and impact the web but small enough to prevent substantial divergence in said web motion direction of the stream of air issuing from the outlet.

4. The apparatus of claim 3 wherein
(1) the width of said outlet is less than 0.080 inch and
(2) the distance between said nozzle and the web is not substantially greater than four times the width of said outlet.

5. A method of ensuring intimate contact between a web that moves lengthwise in one direction along a defined path and a roller with a cylindrical surface around which the web has partial wrapping engagement and which rotates to maintain its said surface at a peripheral speed matching the lengthwise speed of the web, said method being characterized by:

directing towards the web, from the side thereof opposite the roller, a jet of air which
A. extends substantially entirely across the web along a line transverse to the length of the web;
B. impacts the web within a short distance in said direction of web motion from the line of boundary between a straight portion of the web that extends towards the roller and the curved portion of the web that is wrapped around the roller; and
C. impacts the web in a zone which has an extension in said web motion direction that is on the order of a few hundredths of an inch, so as to impose upon the web a pressure gradient in said direction that is high enough to substantially prevent the intrusion of an air film between the web and the roller notwithstanding that the impact pressure of said jet against the web may be relatively low.

6. A method of employing pressurized air to compel a web that moves lengthwise along a defined path to have intimate contact with a cylindrical surface on a roller around which the web has partial wrapping engagement and which rotates to maintain its said surface at a peripheral speed matching the lengthwise speed of the web, and wherein said pressurized air is directed towards the web, from the side of the web opposite the roller, as a jet that impacts the web all across its width, said method being characterized by:

A. constraining said jet to impact the web within a short distance in the direction of web travel from the line of boundary between a straight portion of the web that extends towards the roller and the curved portion of the web that is wrapped around the roller; and B. confining the impact of said jet against the web to a zone that extends in the direction of web travel through a distance on the order of a few hundredths of an inch so as to substantially prevent the intrusion of an air film between the web and the roller.

7. In apparatus wherein a web moves lengthwise in one direction along a defined path and wherein said path has a straight portion in which the web extends in said direction towards a rotatable roller and has a curved portion in which the web is in partial wrapping engagement with said surface of the roller, the boundary between said portions of the path being at a line of tangency, nozzle means at the side of the web opposite the roller, having an outlet from which pressurized air is emitted as a jet directed towards the web to prevent intrusion of an air film between the web and said surface of the roller, the outlet of said nozzle means being in the form of a slot elongated transversely to the length of the web and extending entirely across the web, said outlet being characterized by:

A. a width not substantially greater than is adequate to ensure issuance of pressure air therefrom at a substantially uniform rate all along its length; and B. a location (1) close enough to the web to avoid substantial divergence and dispersion of said jet before it impacts the web and (2) within a small distance in said direction of web motion from said line of tangency.

* * * * *